US008292493B2

(12) United States Patent
Mooring

(10) Patent No.: US 8,292,493 B2
(45) Date of Patent: Oct. 23, 2012

(54) MODULAR MOVEMENT THAT IS FULLY FUNCTIONAL STANDALONE AND INTERCHANGEABLE IN OTHER PORTABLE DEVICES

(75) Inventor: David J. Mooring, Los Altos Hills, CA (US)

(73) Assignee: Wimm Labs, Inc., Los Altos, CA (US)

( * ) Notice: Subject to any disclaimer, the term of this patent is extended or adjusted under 35 U.S.C. 154(b) by 0 days.

(21) Appl. No.: 13/074,197

(22) Filed: Mar. 29, 2011

(65) Prior Publication Data

US 2011/0176395 A1 Jul. 21, 2011

Related U.S. Application Data

(62) Division of application No. 12/024,067, filed on Jan. 31, 2008.

(51) Int. Cl.
*G04B 23/00* (2006.01)

(52) U.S. Cl. ..... 368/276; 368/88; 368/281

(58) Field of Classification Search ..... 368/276, 368/88, 281

See application file for complete search history.

(56) References Cited

U.S. PATENT DOCUMENTS

| | | | | |
|---|---|---|---|---|
| 1,289,155 | A | 12/1918 | Goal | |
| 1,462,076 | A | 7/1923 | Spiro | |
| 2,665,542 | A | 1/1954 | Sheldon | |
| 3,994,124 | A | 11/1976 | Fujita | |
| 4,167,850 | A * | 9/1979 | Schneider | 368/282 |
| 4,264,969 | A | 4/1981 | Walker et al. | |
| 4,462,697 | A | 7/1984 | Thompson | |
| 4,742,503 | A | 5/1988 | Braun et al. | |
| 4,916,679 | A * | 4/1990 | Agnello | 368/283 |
| 4,958,279 | A * | 9/1990 | Proellochs | 368/282 |
| 5,005,161 | A | 4/1991 | Boilen | |
| 5,392,261 | A | 2/1995 | Hsu | |
| 5,657,298 | A | 8/1997 | Choay | |
| 5,943,302 | A | 8/1999 | Fanshaw | |
| 6,431,746 | B1 | 8/2002 | Jujo | |
| 6,525,997 | B1 | 2/2003 | Narayanaswami et al. | |
| 6,527,436 | B1 | 3/2003 | Ng | |
| 6,549,791 | B1 | 4/2003 | Jeon et al. | |

(Continued)

FOREIGN PATENT DOCUMENTS

DE 29513038 U1 11/1995

(Continued)

OTHER PUBLICATIONS

Palm Wrist Watch :: palminfocenter.com/view_story.asp?ID=7992; Sep. 20, 2012.*

(Continued)

*Primary Examiner* — Sean Kayes

(74) *Attorney, Agent, or Firm* — Convergent Law Group LLP

(57) ABSTRACT

A method for manufacturing an interchangeable movement includes assembling parts into a movement subassembly, such that the subassembly is a complete working mechanism; enclosing the subassembly in a body; integrating a glass with the body, wherein the body comprises a single shell with only an opening that receives the glass, sealing the glass and the single shell to enclose the body, thereby creating a water resistant modular movement; and wherein the modular movement is insertable into a case of a portable device having a receptacle for removably receiving the modular movement without tools and in a manner where the glass of the modular movement is visible through the case when the modular movement is inserted.

6 Claims, 8 Drawing Sheets

U.S. PATENT DOCUMENTS

| | | | | |
|---|---|---|---|---|
| 6,556,222 | B1 | 4/2003 | Narayanaswami | |
| 6,570,823 | B1 | 5/2003 | Gilomen | |
| 6,720,860 | B1 | 4/2004 | Narayanaswami | |
| 6,795,377 | B2 | 9/2004 | Gorden | |
| 7,081,905 | B1 | 7/2006 | Raghunath | |
| 7,193,606 | B2 | 3/2007 | Barnett et al. | |
| 7,286,063 | B2 | 10/2007 | Gauthey et al. | |
| 7,682,070 | B2 * | 3/2010 | Burton | 368/294 |
| 7,946,758 | B2 | 5/2011 | Mooring | |
| 2003/0151982 | A1 | 8/2003 | Brewer et al. | |
| 2004/0120224 | A1 | 6/2004 | Meylan | |
| 2006/0018202 | A1 | 1/2006 | Girardin et al. | |
| 2006/0233053 | A1 | 10/2006 | Klein | |
| 2007/0189127 | A1 | 8/2007 | Pollak | |
| 2007/0253290 | A1 | 11/2007 | Aire | |
| 2008/0276168 | A1 | 11/2008 | Mansfield et al. | |
| 2009/0036175 | A1 | 2/2009 | Brandenburg et al. | |

FOREIGN PATENT DOCUMENTS

| | | | |
|---|---|---|---|
| FR | 2735664 | A1 | 12/1996 |
| FR | 2791150 | B1 | 6/2001 |
| GB | 2183063 | A | 5/1987 |
| GB | 2399253 | A | 9/2004 |
| WO | 9813734 | A1 | 4/1998 |

OTHER PUBLICATIONS

Apple User Manual—iPhone 3g—Jul. 30, 2007.

"W100 wrist-watch mobile phone", <http://www.gizmag.com/gol7797f>, Aug. 15, 2007.

"iCool M700 W100 G100 Touch Screen Wrist Watch Cell Phones", <http://www.ic-mall.comficool-m700-w100-g100-touch-screen-wrist-watch-cell-phones-p-1973.htm l> Jan. 1, 2006.

"Touchscreen Cell PhonefPDA Wristwatch", <http://www.thinkgeek.comfgadgets/cellphone/9c9d/> Feb. 28, 2008.

"Abacus WristPDA: a Watch Goes Where no PDA Can Go," <http://www.theinquirer.netfen/ inquirerfnews/2006f04/30fabacus-wristpda-a-watch-goes-where-no-pda-can-go> Feb. 28, 2008.

Wrist Phone M500 Ships this WeeK, <http://Images.google.com/Imgres?Imgurl:..:http:I/www.slashphone.com/medlaldata/800/M500 .jpg&imgrefurl =http://cell-reviews.blogspot.comf2007_05_01_archive. May 31, 2007.

http://www.modumobile.com/ modu—make new connections, pp. 1-3, Jan. 1, 2008.

Youichi Horry et al, A Passive-Stye Butonless Mobile Terminal, IEEE Transactions on Consumer Electronics, Aug. 2003, p. 530, vol. 49, No. 3.

PCT International Search Report and Written Opinion of the International Searching Authority, issued Mar. 3, 2009, application No. PCT/US2009/030777.

Supplementary Extended European Search Report (EESR) of the European Patent Office, issued Jun. 28, 2011, application No. PCT/US2009/030777.

Cellwatch M500 User Manual, <mymobilewatch.com>, May 31, 2007.

* cited by examiner

MODULAR MOVEMENT THAT IS FULLY FUNCTIONAL STANDALONE AND INTERCHANGEABLE IN OTHER PORTABLE DEVICES

CROSS-REFERENCE TO RELATED APPLICATIONS

This application is a Divisional application of U.S. patent application Ser. No. 12/024,067, filed Jan. 31, 2008, and is incorporated by reference.

BACKGROUND OF THE INVENTION

A typical wristwatch usually includes the following essential parts: a movement housed within a case; a piece of glass attached to an opening in the top of the case that covers the top face of the movement; and a case back enclosing the movement within an opening in the back of the case. The movement is the completed, finished inner mechanism contained inside the watch, not including the case or dial, which is responsible for measuring the passage of time (and optionally other information such as date, month and day).

Movements may be entirely mechanical, entirely electronic (potentially with no moving parts), or a blend of the two. A mechanical watch is a watch that uses a non-electric mechanism to measure the passage of time. They are driven by a spring (called a mainspring) which must be wound periodically, and releases the energy to turn the clock's wheels as it unwinds. They keep time with a balance wheel, which oscillates back and forth at a constant rate. Mechanical movements may be automatic (self-winding) or manual (manual winding mechanism).

An example type of electronic movement is a quartz movement used in quartz watches that utilizes frequency of vibrations of a quartz crystal to accurately regulate the operation of the watch. Quartz movements may be automatic (a self-winding rotor mechanism) or battery powered. The majority of watches made today are equipped with electronic movements that feature an analog time display having rotating hands on a face or dial. Some watches may have both analog and digital time readouts for simultaneous display of different information.

Other watches equipped with electronic movements may include digital displays and small computers that are used in many types of electronic devices. For example, a currently available type of electronic watch referred to as a "smart watch" is capable of wireless connectivity via FM broadcasting to provide consumers access to news, weather, sports, stocks, instant messenger, e-mail, and horoscopes on a liquid crystal display (LCD). The type of components found inside the case of a smart watch may include a speaker, a printed circuit board (PCB), a processor, a memory, a radio receiver chip, a rechargeable battery, and an inductive charging coil. The watch may be recharged by placing the watch in a watch stand, and plugging the watch stand into the wall. When a coil attached to the contact surface on the back of the watch comes in contact with a charging plate on the watch stand, the smart watch battery is charged through induction.

Although there may be some differences between the processes used to manufacture a mechanical movement and an electronic computer-based movement, both types of movements are assembled as a collection of parts in what can be characterized as a vertical watchmaking manufacturing process.

Consider by way of example, the process used to manufacture a mechanical watch movement. A mechanical watch movement begins with a raw movement or ébauche, which refers to an incomplete watch movement that is sold as a set of loose parts, comprising a main plate, bridges, a train, a winding and setting mechanism and a regulator. The timing system, the escapement, mainspring, dial, and hands, however, are not usually parts of the "ébauche".

Very few watch manufacturers are capable of producing the parts necessary for ébauches, movements, and the cases to support the production and assembly of finished watches. Instead, most watch companies purchase complete movements from a supplier, such as ETA, fit the movements with dials and hands, and then encase the movements within in-house or contractor-supplied cases. Some watch companies may purchase ébauches from a supplier, finish (polish and decorate) the parts, optionally modify parts of the movement and/or add custom components, and assemble the parts to create a higher-quality or custom movement.

The final steps of the process is case fitting in which the movement is fitted inside the case, which may require further assembly, and finally, case closure. During case fitting, the watch movement is fitted into the case tightly so that it does not move, and in some cases, may be physically attached to the case with screws. After fitting, the case is enclosed with a case back for proper dust and water resistance. Typically, watch companies take great care in how the case back is affixed to the case because this assembly point can be critical for the water tightness of a watch. For example, one method for achieving water resistance is to use gaskets between the case and case back to form a seal, used in conjunction with a sealant applied on the case to help keep water out. Some case backs may be screwed in, or onto, the case.

The vertical watchmaking manufacturing market for electronic movements is similar in that very few companies make all the parts necessary to build a completed electronic watch. Instead, the companies typically purchase electronic movements from suppliers and assemble electronic movements into the cases to complete the watch similar to the above.

BRIEF SUMMARY OF THE INVENTION

One aspect of the exemplary embodiment provides a method for manufacturing an interchangeable movement. Aspects of the exemplary embodiment include assembling parts into a movement subassembly, such that the subassembly is a complete working mechanism; enclosing the subassembly in a body; integrating a glass with the body, wherein the body comprises a single shell with only an opening that receives the glass, sealing the glass and the single shell to enclose the body, thereby creating a water resistant modular movement; and wherein the modular movement is insertable into a case of a portable device having a receptacle for removably receiving the modular movement without tools and in a manner where the glass of the modular movement is visible through the case when the modular movement is inserted.

A further exemplary embodiment discloses a system comprising: a modular movement having a body housing a plurality of layers, including: a top layer of glass, a movement subassembly for displaying information, including time, wherein the modular movement includes all parts necessary for power and operation, including the displaying of the information, and wherein the body housing comprises a single shell with only an opening that receives the top layer of glass, the top layer of glass and the single shell being sealed to enclose the body housing, such that the modular movement is water resistant and fully functional standalone; and a case, the case including a receptacle for removably receiving the modular movement without need for a tool, such that the modular movement is user-interchangeable with another case of another portable device.

DETAILED DESCRIPTION OF THE INVENTION

Figure 1A:
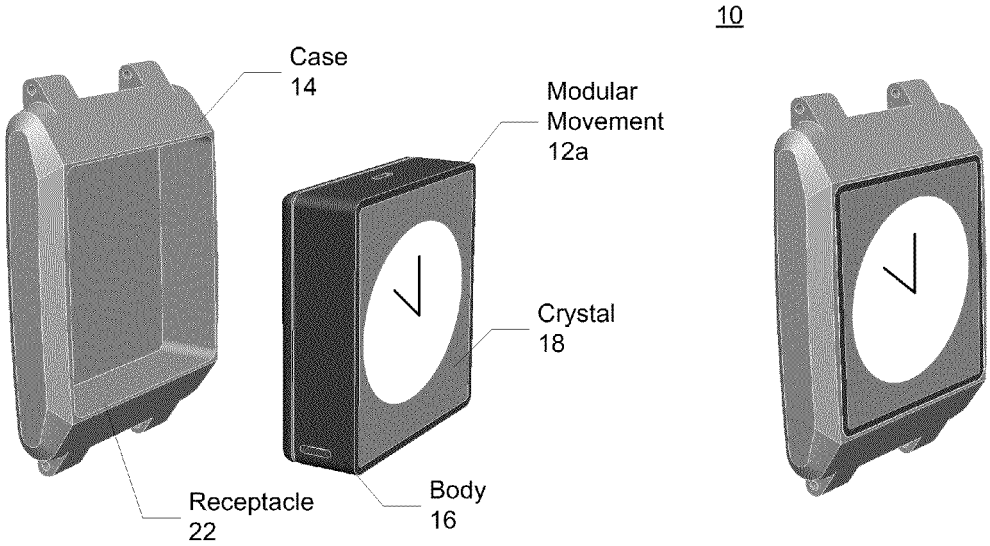
FIGS. 1A-1C are block diagrams illustrating exemplary embodiments of a portable device having a modular movement.

The present invention relates to a modular movement that is both fully functional standalone as well as interchangeable in other portable devices, such as watches. The following description is presented to enable one of ordinary skill in the art to make and use the invention and is provided in the context of a patent application and its requirements. Various modifications to the preferred embodiments and the generic principles and features described herein will be readily apparent to those skilled in the art. Thus, the present invention is not intended to be limited to the embodiments shown, but is to be accorded the widest scope consistent with the principles and features described herein.

Whether a watch utilizes a mechanical or electronic movement, most conventional watches have been designed so that consumers can change the straps or bands of a watch and even interchange the straps between different watches—either for aesthetic or functional reasons. For example, a consumer may wish to change between a casual and a formal strap, change between different color straps, and/or change between a non-waterproof and a waterproof strap, for instance.

One aspect of the present invention is the recognition that due to the history of watchmaking and the resulting vertical watchmaking manufacturing process, conventional watches have not been designed so that consumers can readily change the movement of a watch. That is, due to current construction techniques, the manner in which movements are affixed within the case and/or the manner in which the case back is attached to the case, tools and some amount of skill would be required to remove a movement. In most instances, some disassembly of the movement may be even necessary to remove the movement from the case, thereby ensuring that the movement will no be longer fully functional after removal without repair and reassembly.

Furthermore, even assuming the consumer succeeded at removing a movement from a case, the manner in which watches and movements are constructed today would cause further problems for the consumer. For example, if a consumer removed a mechanical movement from a completed watch, the fully functional movement would include hands and dials. However, once the movement is removed from the case and the attached glass, the hands and dials of the movement would be unprotected and could easily be damaged by handling. In this regard, since with convention watches it is the watch that is water resistant or waterproof, removing the movement from the watch may expose the movement to moisture, for which the movement would have little if no protection.

The exemplary embodiment of the present invention provides an improved movement and method of manufacturing thereof that enables consumers to change the movement of a portable device, such as a watch. No tools or disassembly/assembly of either the portable device or the movement are necessary; and the movement itself is modular and durable in construction such that the movement is fully-functional standalone and therefore retains its functionality after removal from the portable device. The modular movement is also easily user-interchangeable with other portable devices.

Figure 1B:
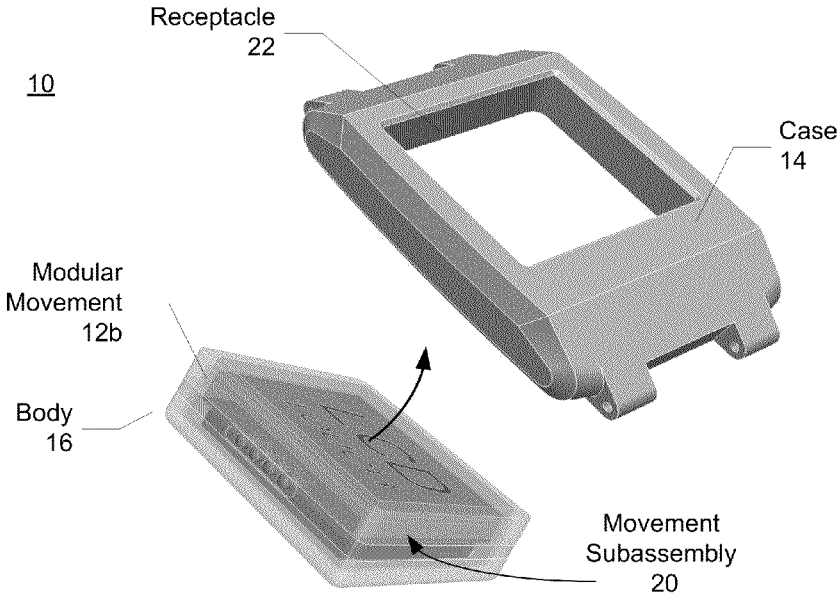
Figure 1C:
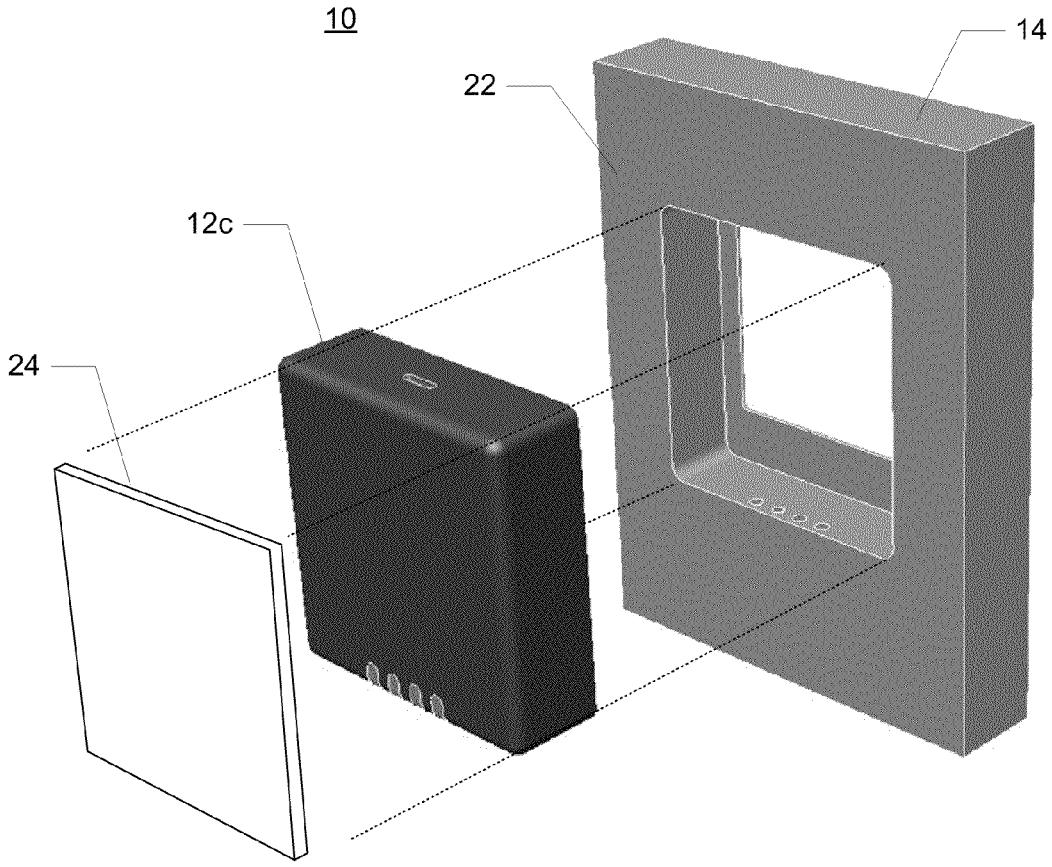

FIGS. 1A-1C are block diagrams illustrating exemplary embodiments of a portable device 10 having a modular movement where like components have like numerals have like reference numerals. According to the exemplary embodiments, modular movements 12*a*, 12*b* and 12*c* (hereinafter modular movement 12 when refereed to collectively) are provided that can be removably inserted within a case 14 of the portable device 10. In the exemplary embodiments shown, the portable device 10 comprises a watch although the bands are not shown, but the portable device 10 may represent other types of devices, as described below.

According to the exemplary embodiments, the modular movement 12 includes a body 16 that houses a plurality of layers, including an integrated top layer of glass 18, and a movement subassembly 20, for displaying information, including time. FIG. 1B is a diagram of modular movement 12*b* showing a semitransparent body 16 for convenience so that subassembly 20 can be seen through case 16.

As used herein, the term "modular" means that the body 16 of the modular movement 12 includes all parts necessary for operation and power of the modular movement 12. Thus, the modular movement 12 of the exemplary embodiment is fully functional in a standalone state. However, according to the exemplary embodiment, the case 14 of the portable device 10 includes a receptacle 22 for removably receiving the modular movement 12 without need for a tool, such that the modular movement 12 can be either used with the case 14 of the portable device 10 and/or is user interchangeable with the cases of other portable devices having the same or similar types of receptacles.

When the modular movement 12 is used in a portable device 10, such as a watch, the glass 18 of the module of movement 12 becomes the glass 18 of the portable device. The glass 18 may include any type of transparent or semi-transparent material layer on a top surface of the modular movement 12, including sapphire, crystal, plexiglass, and the like.

In one embodiment, the body 16 may be constructed to provide the modular movement 12 with a degree of water resistance and dust protection. For example, the body 16 may be a single shell except for an opening for the glass 18 and once the glass 18 is in place, the glass 18 may by sealed with the body 16 using traditional waterproofing methods. In another embodiment, the body 16 may be assembled in separate pieces but then sealed once assembled.

Providing a modular movement 12 having an enclosed and self-contained body 16 including the glass 18 is in contrast to traditional watchmaking methods in which 1) the parts of the movement are not integrated into a body, and 2) the watch glass is typically affixed to the watchcase, rather than to the watch movement.

In one exemplary embodiment, the modular movement 12 and the receptacle 22 in the case 14 are made industry standard sizes, such that different modular movements 12 manufactured and sold by a one set of manufacturers fit within the receptacles of different cases manufactured and sold by another set of manufacturers, for example.

FIG. 1A shows an embodiment where the receptacle 22 is formed as an opening on the top or front of the case 14 and the modular movement 12*a* is inserted into the front of the case 14 through the open receptacle 22. In one embodiment, the receptacle 22 may only extend partially through the depth of the case body, leaving one side, i.e., the back, of the case 14 closed.

FIG. 1B shows another embodiment where the receptacle 22 is formed as an opening in the back of the case 14 and where the top or front of the case 14 includes an opening. In this embodiment, the modular movement 12*b* is inserted into the case 14 from the bottom or back of the case 14, and once inserted the glass 18 of the modular movement 12*b* is visible through the opening in the top of the case 14.

Although FIGS. 1A and 1B show that once the modular movement 12*b* is inserted into the receptacle 22, no closure is necessary to seal the case 14 unlike with traditional watches. FIG. 1C is a diagram illustrating that in an alternative embodiment, a receptacle door 24 may be used to close the case 14 once modular movement 12*c* is inserted into the receptacle 22. In another embodiment, the receptacle door 24 may be attached to the case 14 via a hinge.

As used herein, the portable device 10 may include a combination of both the case 14 and the modular movement 12. But the term case 14 may denote the body of the portable device 10 into which the receptacle 22 is formed and into which the modular movement 12 is to be inserted. Thus, for small portable devices 10, such as a watch, the proportionate size of the portable device/case to the receptacle 22 is small (FIGS. 1A and 1B). But for larger portable devices, the size of the portable device/case to the receptacle 22 may be larger (e.g., FIG. 1C).

According to an exemplary embodiment, the modular movement 12 may be a mechanical movement or an electronic movement. FIG. 1A may illustrate an embodiment where the modular movement 12*a* is implemented as a mechanical movement. In this exemplary embodiment, the subassembly 20 within the body 16 of modular movement 12*a* would include a mechanical movement comprising not only components of a traditional raw movement such as a main plate, bridges, a train, a winding and setting mechanism and a regulator; but also a timing system, an escapement, a mainspring, and a time display such as dial and hands. The time display may be covered by the glass 18. The mechanical movement of the subassembly may be automatic or manual. The winding and setting mechanism may include a component, such as a push-in crown, built into the case 14 that when pushed-in, would engaged with a recess in the side of the modular movement to interact with the winding and setting mechanism.

FIGS. 1B and 1C illustrate example embodiments where the modular movements 12*b* and 12*c* are implemented as an electronic movement. Examples of an electronic movement may include a quartz movement with an analog or digital display, and with or without a battery. Another example of an electronic movement may include a computer-based movement with a touchscreen or LCD display and battery, for instance.

Figure 2:
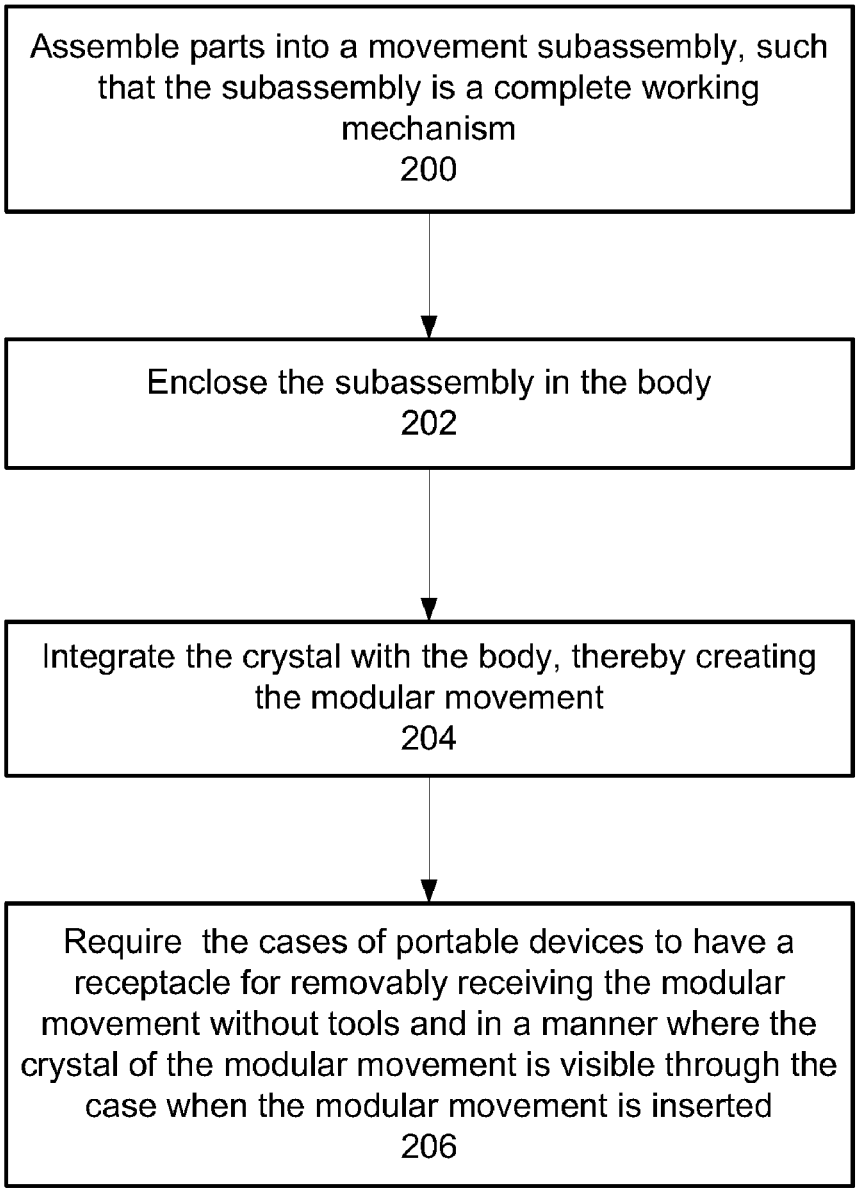
FIG. 2 is a flow chart of a process for manufacturing an interchangeable modular movement.

FIG. 2 is a flow chart illustrating a process for manufacturing an interchangeable modular movement 12. The process may begin by assembling parts into the movement subassembly 20, such that the movement subassembly 20 is a complete working mechanism (block 200). The movement subassembly 20 is then enclosed in the body 16 (block 202); and the glass 18 is integrated with the body 16, thereby creating the modular movement 12 (block 204). In one exemplary embodiment, the modular movement 12 may be provided with a standard size and shape so that different modular movements from different manufacturers have the same size. For example, in one embodiment, the standard size and shape of the modular movement 12 may be approximately 30 mm wide, 34 mm tall, and 8 mm in depth, for example. In another embodiment, the modular movement 12 may have a size and shape of approximately 32×32×10 mm, for example. Thus, any sizes ranging approximately around these dimensions should be suitable for the modular movement 12.

Another step to the process is requiring the cases 14 of portable devices 10 to each have a receptacle 22 for removably receiving the modular movement 12 without tools and in a manner where the glass of the modular movement 12 is open or at least visible through the case 14 when the modular movement 12 is inserted (block 206).

The receptacle 22 should be designed so that no tools are required for modular movement 12 insertion or ejection so that the modular movement 12 is easily user interchangeable. According to the exemplary embodiment, several different latching mechanisms may be used to retain the modular movement 12 inside the receptacle 22. For example, the receptacle 22 may be provided with internal latching mechanisms such as snaps, clamps or springs, for example. In another embodiment, a mechanism may be used that pressurizes the modular movement 12 into the receptacle 22 from the outside of the case 14. In yet another embodiment, contacts 510 on the modular movement 12 may be provided with springs that hold the modular movement 12 in place when inserted.

In yet another embodiment, at least one wall of the receptacle 22 may be provided with one or more magnets that have sufficient attraction force to hold modular movement 12 in place when inserted. A spring loaded decoupling mechanism could be used to then eject the modular movement 12.

Also, in a watch or other wearable portable device 10 embodiments where the back of the case 14 is open, any of the latching mechanisms may be calibrated to account for when the case 14 is worn and the modular movement 12 is inside the receptacle 22, the modular movement 12 may be held inside the receptacle 22 at least in part by the wearer's body (e.g., by a wrist).

Requiring no tools for insertion or ejection of the modular movement 12 may be a function of both the design of the receptacle 22 and the case 14. The design of the receptacle 22 and case 14 also affect how the inserted modular movement 12 will be visible through the case 14.

Figure 3:
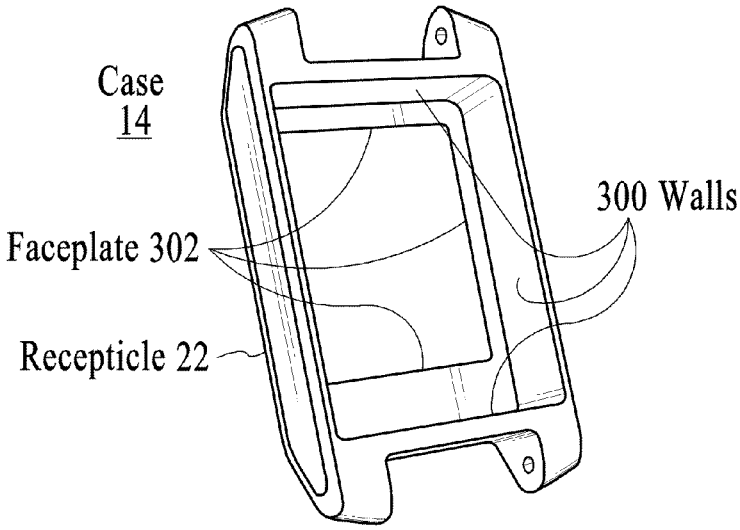
FIG. 3 is another diagram illustrating the exemplary embodiment of the receptacle formed in the rear of the case.

FIG. 3 is a diagram illustrating a rear view of the case 14 and the receptacle 22 according to one exemplary embodiment. The receptacle 22 may be formed in the case 14 by a set of sidewalls 300 whose number, shape, size, and depth should be substantially similar to those of the side walls of the modular movement 12. In addition, the case 14 may be provided with a faceplate 302 that may function to aid in retaining the modular movement 12 inside the case 14 as well as defines which portions of the modular movement 12 are visible through the case.

Figure 4A:
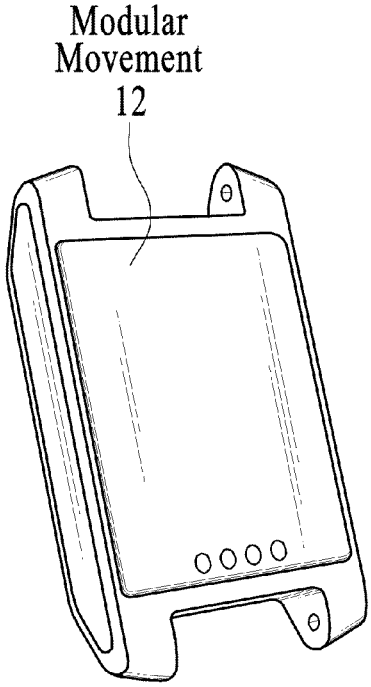
FIGS. 4A and 4B are diagrams illustrating the modular movement inserted into the receptacle of the case.
Figure 4B:
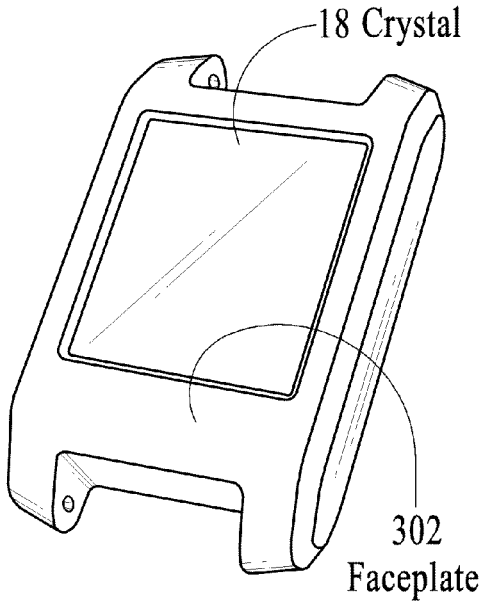

FIGS. 4A and 4B are diagrams illustrating the modular movement inserted into the receptacle of the case. In one embodiment, the depth or thicknesses of the modular movement 12 and the case 14 may be designed to be substantially similar, so that when the modular movement 12 is inserted, the side of the modular movement 12 facing the open end of the receptacle 22 is coplanar with the back of the case 14 (and the wearer's arm), as shown in FIG. 4A. As shown in FIG. 4B, the glass 18 of the modular movement 12 that is open through the faceplate 302 of the case 14 may be designed to be approximately coplanar with (or slightly above or below) the top of the case 14.

In some embodiments, the modular movement 12 may have its front and back sides open in the front and rear of the case 14. However, some measure of protection may be provided by configuring the receptacle 22 so that the four sidewalls 300 of the receptacle 22 fully cover the four remaining sides of the modular movement 12, as shown. Also, although openings for the modular movement 12 are shown in the front and rear of the case 14 via the faceplate 302 and receptacle 22, in another embodiment, the receptacle 22 may also be formed on a side, bottom or top of the case as well, particularly for other types of portable devices 10 and form factors.

In a further embodiment, the faceplate 302 may be provided in any shape desired, such as square, round, oval, triangular or rectangular, for instance, and the shape of faceplate 302 may be different than the shape of the modular movement 12. Thus, in the case of a watch, although a square or rectangular modular movement 12 is inserted into a square or rectangular receptacle 22 in the case 14, the modular movement 12 may be given the appearance of a round face by providing the case 14 with a round faceplate 302. Similarly, in the case of a round modular movement 12, the case may be given a square or rectangular faceplate 302 if desired. Accordingly, the case 14 design has no restrictions on what faceplate/movement shape combinations that can be used. Any shaped faceplate 302 may be applied to the case 14 for use with any shaped modular movement 12 and correspondingly shaped receptacle 22.

According to another aspect of the exemplary embodiment, the modular movement 12 is implemented as a computer-based electronic movement that is used to power the portable devices into which it is inserted, as described below.

Figure 5:
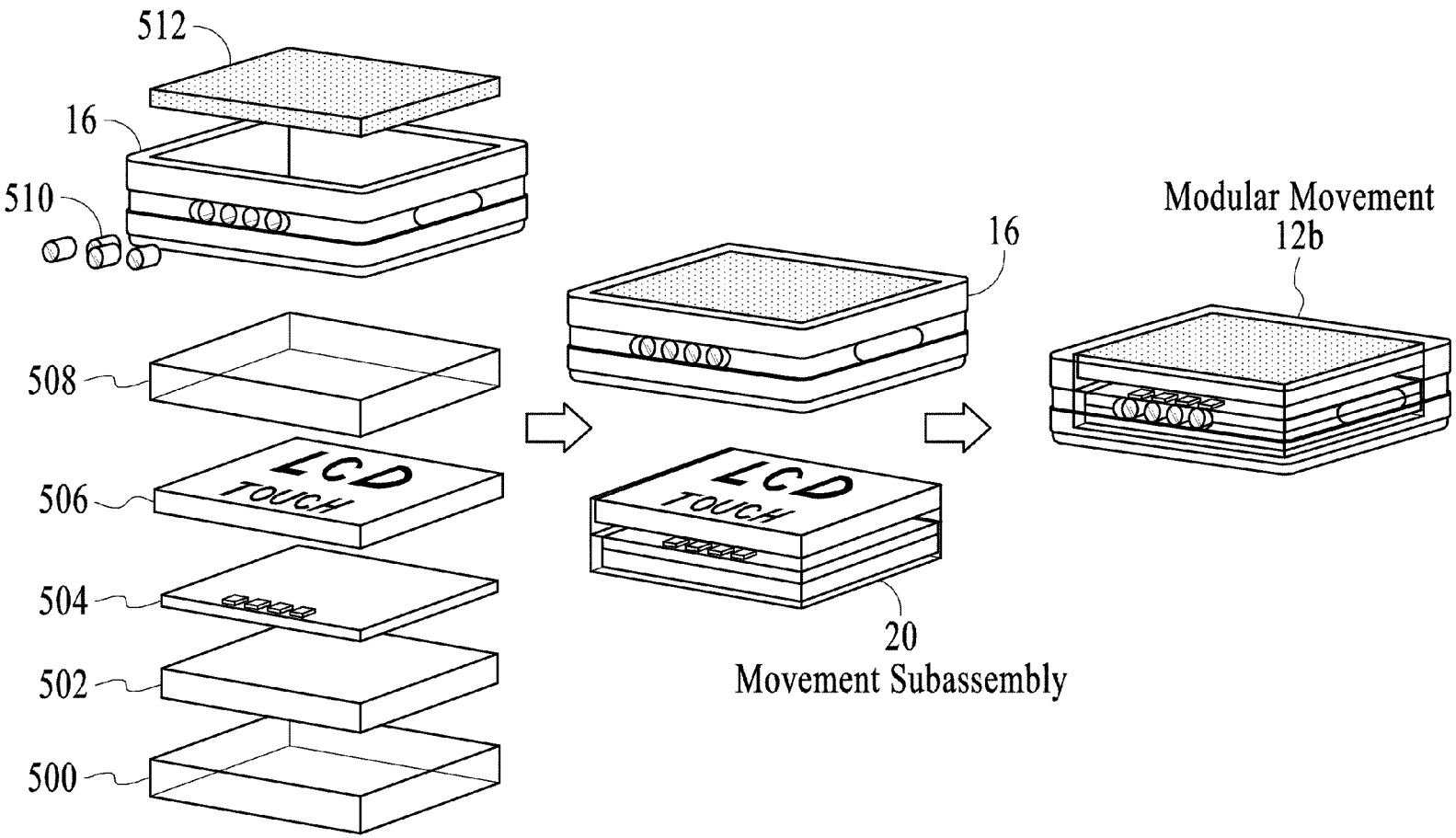
FIG. 5 is a diagram of an exploded view of the modular movement and components thereof when implemented as a computer-based electronic modular movement according to one exemplary embodiment.

FIG. 5 is a diagram of an exploded view of the modular movement and components thereof when implemented as a computer-based electronic modular movement according to one exemplary embodiment. As shown, the modular movement 12 includes body 16 that houses multiple layers of components, which in this exemplary embodiment, may include a plastic internal chassis 500, a rechargeable-type battery 502, a printed circuit board (PCB) 504, a touchscreen 506, and an optional second plastic internal chassis 508 and protective covering 512. In this embodiment, the modular movement 12 has six sides, but the side with the touchscreen is substantially all display space.

The PCB 504 may include components (described below) such as a memory and processor for executing software that displays a user interface on the touchscreen 506 and that operates the modular movement 12*b*; and an optional communications interface for receiving data remotely, which may be displayed and updated on the touchscreen 506.

Other components of the modular movement 12*b* may include an antenna (not shown) that wraps around the body 16 (alternatively embedded in case 14), and a set of contacts 510 inserted into the body 16 and in contact with the PCB. The contacts may be used for recharging the battery (the contacts are both power and ground) and/or for serialized communications. The contacts can also be used for orientation purposes for the user to tell which side of the modular movement 12*b* is up or down when inserting the modular movement 12*b* into the receptacle 22 of the case 14. In one embodiment, the contacts 510 are located on a side of the modular movement 12*a* that is in the receptacle 22 opening so that the portable device 10 as a whole can be placed in a dock and the contacts 510 used to abut the contacts of the dock. In another embodiment, the contacts 510 are located on a side of the modular movement 12*b* that face inward into the receptacle 22 for abutting with contacts in the receptacle 22. In yet another embodiment, the contacts 510 may be located on the modular movement 12*b* such that the contacts 510 wrap around at least two side of the modular movement 12*b* to be used in both manners.

During assembly, the contacts 510 are inserted into the body 16; and the layers of components are assembled as shown into a movement subassembly 20. The movement subassembly 20 is then inserted into the body 16 and the body is sealed, creating the computer-based modular movement 12*b*.

Figure 6:
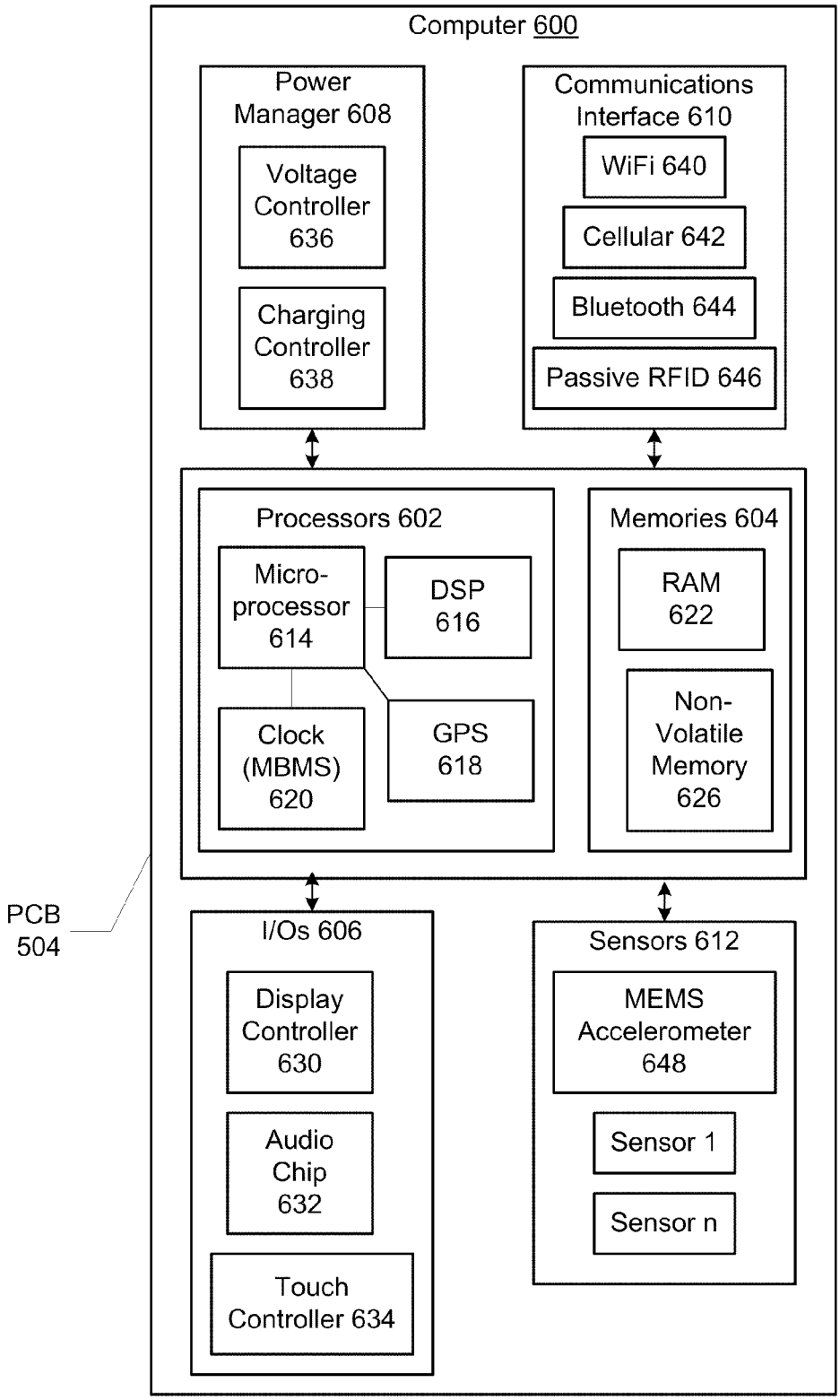
FIG. 6 is a block diagram illustrating computer components on the PCB comprising the modular movement according to an exemplary embodiment.

FIG. 6 is a block diagram illustrating computer components on the PCB comprising the modular movement 12*b* according to an exemplary embodiment. In one embodiment, the PCB 504 containing computer 600 may be implemented as a single sided or double-sided PCB. In another embodiment, the PCB 504 may be implemented as separate PCBs and stacked within the movement subassembly 514.

Computer 600 may include components such as processors 602, memories 604, inputs/outputs 606, power manager 608, a communications interface 610, and sensors 612. In one embodiment, one or more of the components of the computer 600 may be implemented on a single chip.

The processors 602 may include at least one microprocessor 614, a digital signal processor (DSP), a global positioning chip (GPS) 616, and a clock 620. Microprocessor 614 and/or DSP may be capable of concurrently executing multiple software routines, including system code, to control the various processes of the modular movement 12*b*. In one embodiment, microprocessor 614 may comprise an Advanced RISC Machine (ARM) processor or the like may be used, for example. GPS 618 may process received signals and with or without microprocessor 614 determine position information such as location, speed, direction, and time.

Clock 620 may be used as an internal timing device for the computer 600. Clock 620, which may also be referred to as a real-time clock or system clock, inputs to the microprocessor 614 a constant flow of timing pulses for operation of the microprocessor 614. Clock 620 may also keep track of the time of day and makes this data available to the software routines executing in microprocessor 614. In one embodiment, clock 620 comprises a silicon clock oscillator implemented using micro-electro-mechanical systems (MEMS) technology. In another embodiment, clock 620 may utilize a quartz crystal oscillator.

Memories 604 may include a random access memory (RAM) 622 and a nonvolatile memory 626. RAM 622 may be used as the main memory for microprocessor 614 for supporting execution of the software routines and other selective storage functions. Non-volatile memory 626 is capable of holding instructions and data without power and may store the software routines for controlling modular movement 12*b* in the form of computer-readable program instructions. In one embodiment, non-volatile memory 626 comprises flash memory. In alternative embodiments, non-volatile memory 626 may comprise any type of read only memory (ROM).

I/Os 606 may include a display controller 630, an audio chip 632, and a touchscreen controller 634. Display controller 630 may access RAM 622 and transfer processed data, such as time and date and/or a user interface, to the touchscreen 506 for display. The audio chip 632 is coupled to an optional speaker (not shown) and interfaces with microprocessor 614 to provide audio capability for the modular movement 12*b*. In another embodiment, the audio chip 632 may be coupled to both a speaker and a microphone (not shown). In this embodiment, a water resistant/proof speaker and microphone may be used to retain water resistance of the modular movement 12*b*. In an alternative embodiment, the modular movement 12*b* may be implemented without sound capability, in which case no audio chip 632, speaker or microphone is necessary.

In the embodiment where the audio chip 632 is coupled to both a speaker and microphone, the microphone may record voice input that is first processed by the audio chip and then input to the microprocessor 614 for further processing. The audio chip 632 may include hardware and/or software that converts analog voice into pulse code modulation (PCM) or Adaptive Differential PCM (ADPCM) digital code and vice versa, as well as for compressing and decompressing the PCM or ADPCM digital audio signal. In one embodiment, the processed voice input may be stored for subsequent playback. In another embodiment, the processed voice input may be transferred to communications interface 610 for wireless transmission.

Touch controller 634 may interface with the touchscreen 506 to detect touches and touch locations and pass the information on to microprocessor 614 for determination of user interactions. Another example I/O 606 may include a USB controller (not shown).

Power manager 608 communicates with the microprocessor 614 and coordinates power management for the computer 600 while the computer is drawing power from the battery 502 during normal operations. In one embodiment, the battery 502 may comprise a rechargeable, lithium ion battery or the like may be used, for example. The power manager 608 includes a voltage controller 636 and a charging controller 638 for recharging the battery 502. Voltage controller 636 may regulate battery voltage to the rest of the computer 600, and charging controller 638 may manage appropriate voltage levels to properly charge the battery 502. Power manager 608 may further include a microcontroller (not shown) in one embodiment.

The communications interface 610 may include components for supporting one-way or two-way wireless communications. In one embodiment, the communications interface 610 is for primarily receiving data remotely, including streaming data, which is displayed and updated on the touchscreen 506. However, in an alternative embodiment, besides transmitting data, the communication interface 616 could also support voice transmission. In an exemplary embodiment, the communications interface 610 supports low and intermediate power radio frequency (RF) communications. The communications interface 610 may include one or more of a WiFi transceiver 640 for supporting communication with a WiFi network, including wireless local area networks (WLAN), and WiMAX; a cellular transceiver 642 for supporting communication with a cellular network; Bluetooth transceiver 644 for low-power communication according to the Bluetooth protocol and the like, such as wireless personal area networks (WPANs); and passive radio-frequency identification (RFID) 646. Others wireless options may include baseband and infrared, for example. The communications interface 610 may also include other types of communications devices (not shown) besides wireless, such as serial communications via contacts 510 and/or USB communications, for example.

Sensors 612 may include a variety of sensors including a MEMS accelerometer 648, and any number of optional sensors 1-n. MEMS accelerometer 648 may be used to measure information such as position, motion, tilt, shock, and vibration for use by microprocessor 614. The computer 600 may additionally include any number of optional sensors 1-n, including environmental sensors (e.g., ambient light, temperature, humidity, pressure, altitude, etc), biological sensors (e.g., pulse, body temperature, blood pressure, body fat, etc.), and a proximity detector for detecting the proximity of objects. In one embodiment, the proximity detector may be implemented as an infrared data association (IRDA) proximity detector. The computer 600 may display the information measured from the sensors 612, analyze the information by microprocessor 614 and display the analyzed information, and/or transmit the raw or analyzed information via the communications interface 610. In one embodiment, not all of the sensors 612 may be located on PCB 504.

In a further aspect of the exemplary embodiment, the modular movement 12*b* may include more than one battery 502 and/or the portable device 10 may include one or more external batteries (not shown). In this embodiment, the modular movement 12*b* may be configured via the software routines and power manager 614 to selectively determine whether to draw power from the battery or batteries 502, the external battery or batteries, or a combination thereof depending on a variety of factors such as current operating conditions and the percentage of battery power remaining in each of the batteries. In the case of a watch, for example, a band and case assembly may include a left strap and a right strap, and may further include a left battery in the left strap and a right battery in the right strap. In this embodiment, the modular movement 12*b* may be configured to selectively determine whether to use battery 502, the left battery, and/or the right battery, or some combination of the three.

In a further aspect of the exemplary embodiment, the receptacle 22 of the standard size that is designed to receive the modular movement 12*b* may be built into the case of any type of portable device 10.

Figure 7:
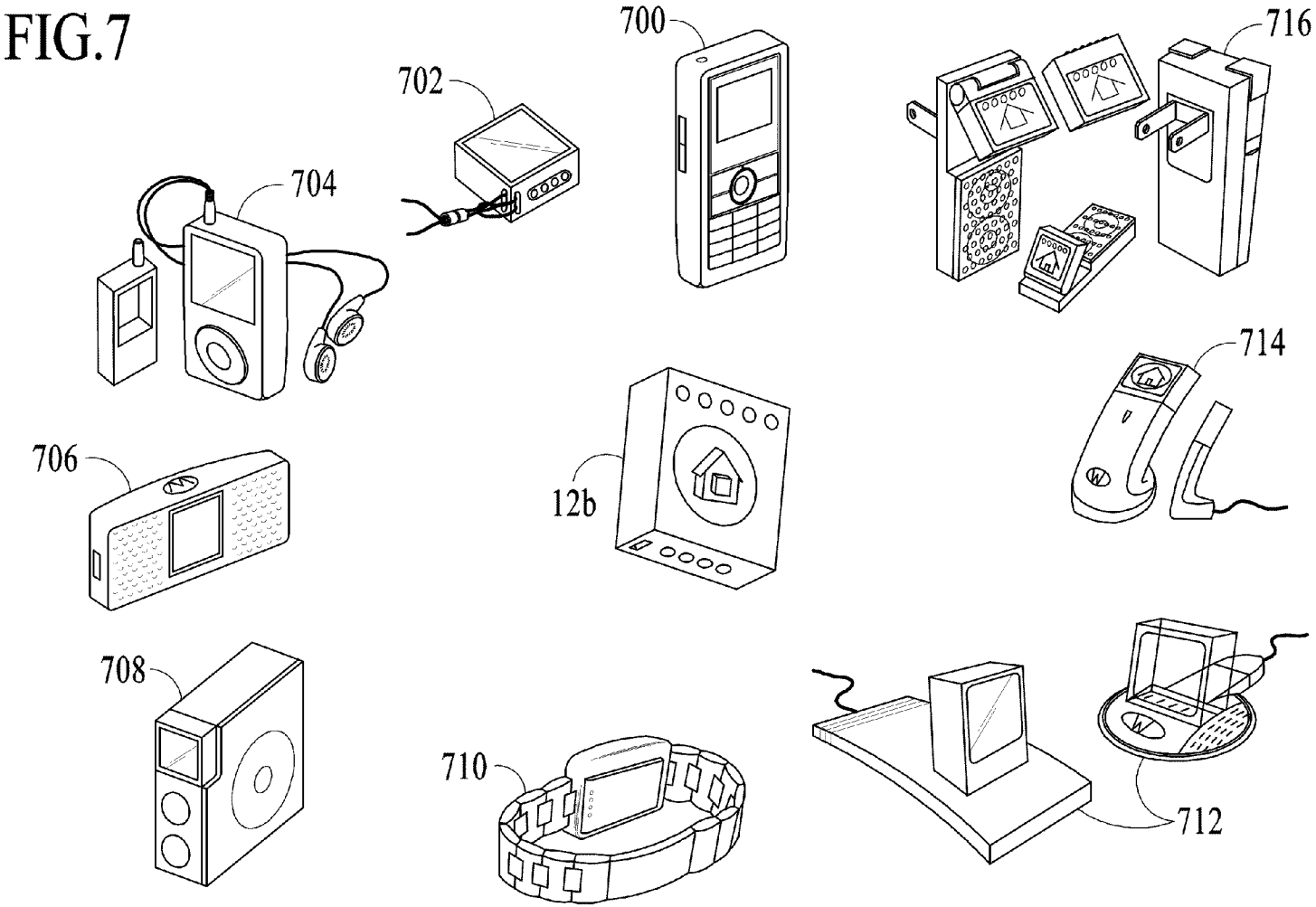
FIG. 7 is a diagram illustrating exemplary types of portable device form factors that could be used with modular movement and receptacle.

FIG. 7 is a diagram illustrating exemplary types of portable device form factors that could be used with modular movement 12*b* and receptacle 22. As shown exemplary types of portable devices that may include standard receptacles 22 for use with modular movement 12*b* may include a cell phone handset 700, a carrier and strap 702, a media player 704, portable speakers 706, battery dock recharger and speaker 708, a watch 710, a media handset and cradle 712, a telephone handset 714, and a portable charging cradle 716 for the modular movement 12*b*. Through the use of charging cradle 716, the modular movement 12*b* can be recharged, even while outside of the portable device 10. Thus, the exemplary embodiment provides a module movement 12*b* that can be used, operated and recharged whether both alone and when inserted into the portable device 10. Other example portable devices include a bike handlebar cradle, a modem housing (e.g., for notebook computers), an adapter to convert to a USB dongle, jewelry, a lanyard, clothing, a keychain and a necklace, for instance.

Thus, according to the exemplary embodiment, the modular movements 12*b* made by the same or different manufacturers may be interchangeable by users into various portable devices 10 made by different manufacturers due to the standard form factor designs of the modular movements and receptacles 22. Once inserted into the portable device 10, the modular movement 12*b* operates and optionally powers the portable device 10. If the modular movement is equipped with the user's personal information and wireless connectivity, the user may carry the modular movement 12*b* around wherever the user goes and may plug the modular movement 12*b* into whatever compliant portable devices 10 are available.

For example, consider the scenario in which a user wakes up in the morning, and while shaving plugs the modular movement 12*b* into a receptacle 22 next to the mirror. Thereafter, the modular movement 12*b* streams stocks, weather and the like for the user via an Internet connection made using the RF communications interface 610. When it is time to leave for work, the user removes the modular movement 12*b* from the receptacle 22 and inserts the modular movement 12*b* into his or her watch 710 or cell phone handset 700, and takes the modular movement 12*b* along. In addition, if the modular movement 12*b* is equipped with RFID, the modular movement 12*b* may be used for automatic payment of goods and services. The user may use the modular movement 12*b* to carry or access his or her personal information, such as email, contacts, voicemail, etc., stream real-time data and media, and may even use the modular movement 12*b* in the place of cash and credit cards.

Figure 8:
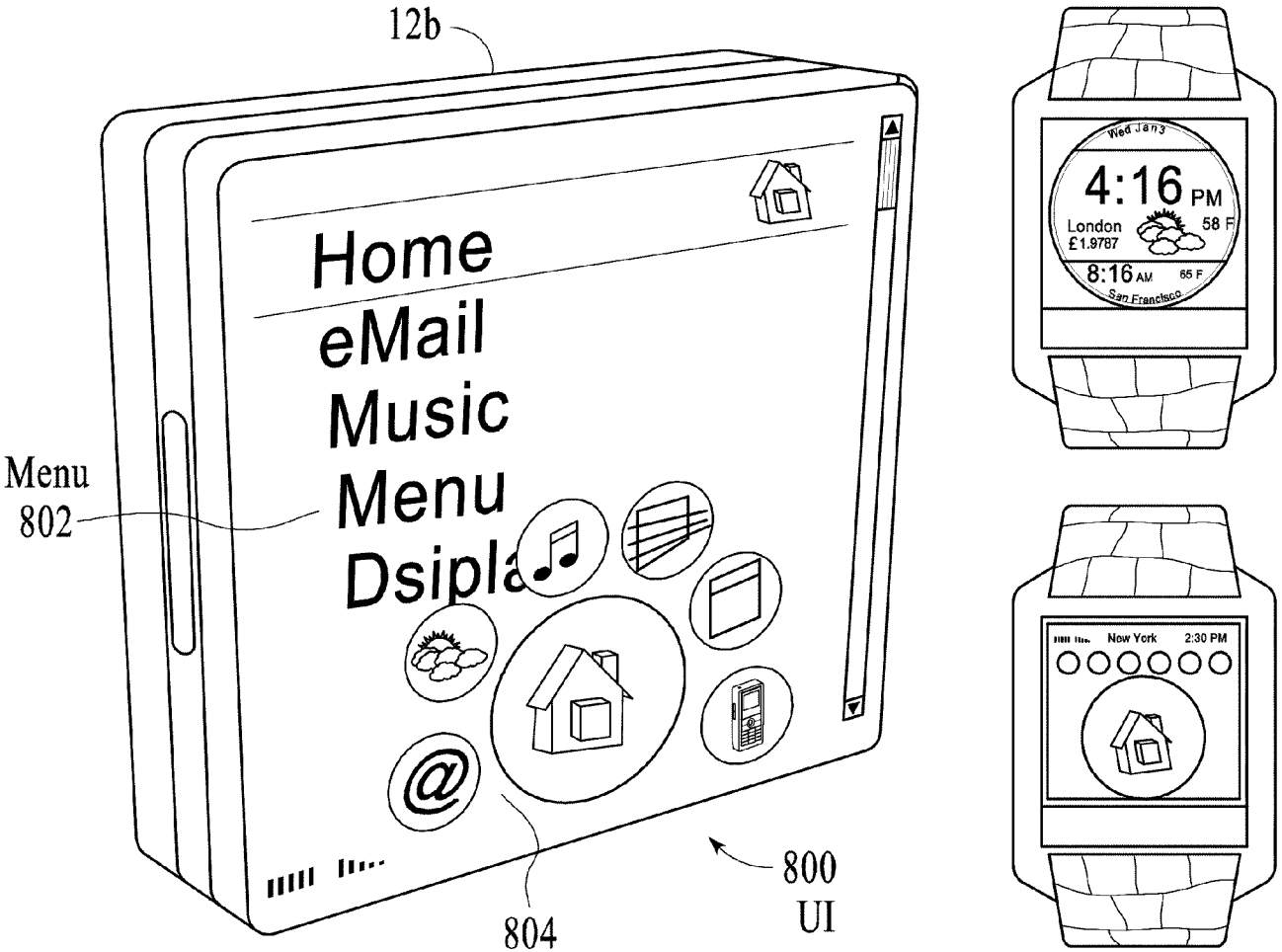
FIG. 8 is a diagram illustrating several views of an exemplary user interface that may be displayed on the modular movement.

FIG. 8 is a diagram illustrating several views of an exemplary user interface that may be displayed on the modular movement 12*b*. In one embodiment, the user interface 800 displayed on the touchscreen 506 of the modular movement 12*b* may include menu items 802 and/or an icon carousel 804. The icon carousel 804 is a scrollable display of icons that are laid out along an arc of the wheel across the touchscreen 506, where only a subset of the icons (e.g., five, 2 on each side of a center position) are visible on the touchscreen 506 at a time. The user may rotate/scroll the icons around the icon carousel 804 to the left or right with a swipe of the finger in the corresponding direction along the icon carousel 804. When the rotating icon carousel 804 stops rotating, the icon in the center position is the currently active icon that can be selected or activated. The user may select one of the menu items 802 or the currently active icon with a finger touch or double touch. In one embodiment, as the icons scroll around the icon carousel 804, whichever icon is displayed in the center position may automatically enlarge for ease of viewing. Other embodiments are also shown in FIG. 8, such as the user interface 800 displayed on a watch with a round faceplate 302, and the icon carousel 804 displayed with an analog clock display.

It should be noted that the user interface 800 has no buttons on the modular movement 12*b*. Instead, the user interface 800 of the modular movement 12*b* is controlled entirely by the user interacting with the touchscreen 506 through touch, such that a button or a dial for controlling the user interface are completely absent from both the modular movement and the case 14, thereby simplifying user interface 800 and saving manufacturing costs. In one embodiment, a button may be provided on the side of the modular movement 12*b*, for resetting, but not for controlling user interface 800. In an alternative embodiment, the modular movement 12*b* may be automatically reset when first plugged-in to be recharged, or the recharging cradle may be provided with a reset button.

In the embodiment where the touchscreen 506 of the modular movement 12 is open through the faceplate 302 of the case 14 and is slightly below the top of the case (e.g, FIG. 4B), the UI may be designed such that the edges of the case 14 surrounding the touchscreen 506 are used as guides to the user's fingers as the user makes finger gestures across the touchscreen 506.

In a further embodiment, the user interface may be provided with auto configuration settings. In one auto configuration embodiment, once the modular movement 12*b* is inserted into the receptacle 22 of the case 14, the modular movement 12*b* may be configured via contacts 510 or wirelessly to automatically determine characteristics of the case 14, such as the make, model, and shape of the faceplate 302 and/or receptacle 22 opening. Using the characteristics of the case 14, the modular movement 12*b* may automatically configure its user interface 800 accordingly. For example, if the modular movement 12*b* detects that it is inserted into a case (e.g., via a corresponding set of contacts in the receptacle) having a rectangular or square faceplate 302 that does not overlap the glass 18 of the touchscreen 506 in any way, then no changes to the user interface 800 need to be made. If, however, the modular movement 12*b* detects that it is inserted into a case having a round or oval faceplate 302 that overlaps the corner of the touchscreen 506, and therefore eliminates areas of the screen space, i.e., the corners, then the modular movement 12*b* may automatically reconfigure the user interface 800 to display information only in the available areas of the touchscreen 506.

In another auto configuration embodiment, the orientation of user interface may automatically change in response to the modular movement 12*b* detecting a change in the orientation of the modular movement 12*b*.

A modular movement that is both fully functional standalone and interchangeable in other portable devices, such as watches, has been disclosed. The present invention has been described in accordance with the embodiments shown, and one of ordinary skill in the art will readily recognize that there could be variations to the embodiments, and any variations would be within the spirit and scope of the present invention. For example, the portable device may be provided without communication capability and used to store a user's personal information, such as medical records for, instance.

In addition, the embodiments can be implemented using hardware, software, a computer readable medium containing program instructions, or a combination thereof. Software written according to the present invention is to be either stored in some form of computer-readable medium such as memory or is to be transmitted over a network, and is to be executed by a processor. Consequently, a computer-readable medium is intended to include a computer readable signal, which may be, for example, transmitted over a network. Accordingly, many modifications may be made by one of ordinary skill in the art without departing from the spirit and scope of the appended claims.

We claim:

1. A method for manufacturing an interchangeable movement comprising:

assembling parts into a movement subassembly, such that the subassembly is a complete working mechanism, enclosing the subassembly in a body, and integrating a glass with the body, wherein the body comprises a single shell with only an opening that receives the glass, sealing the glass and the single shell to enclose the body, thereby creating a water resistant modular movement;

inserting the modular movement into a case of a portable device having a receptacle formed in an opening in a rear of the case for removably receiving the modular movement without tools and in a manner where the glass of the modular movement is visible through the case when the modular movement is inserted; and calibrating a latching mechanism of the case to account for when the case is worn and the modular movement is inserted into the receptacle, the modular movement is held inside the receptacle at least in part by a wearer's body.

2. The method of claim 1 further comprising:

forming the receptacle in the case with a set of sidewalls whose number, shape, size, and depth are substantially similar to those of the modular movement; and providing the case with a faceplate that aids in retaining the modular movement inside the case and defines which portions of the front of the modular movement are visible through the case.

3. The method of claim 2 wherein the depth of the modular movement and the case are substantially similar so that when the modular movement is inserted into the receptacle, one side of the modular movement is coplanar with an open end of the case, and wherein the glass that is open through the faceplate is approximately coplanar with a top of the case.

4. The method of claim 3 further comprising providing the faceplate with a shape different from that of the modular movement.

5. The method of claim 1 further comprising providing the modular movement with a subassembly comprising at least one of a mechanical movement and an electronic movement.

6. A system, comprising:

a modular movement having a body housing a plurality of layers, including:

a top layer of glass, a movement subassembly for displaying information, including time, wherein the modular movement includes all parts necessary for power and operation, including the displaying of the information, and wherein the body housing comprises a single shell with only an opening that receives the top layer of glass, the top layer of glass and the single shell being sealed to enclose the body housing, such that the modular movement is water resistant and fully functional standalone; and a case, the case including a receptacle formed in an opening in a rear of the case for removably receiving the modular movement without need for a tool, such that the modular movement is user-interchangeable with another case of another portable device, wherein the case includes a latching mechanism that is calibrated to account for when the case is worn and the modular movement is inserted into the receptacle, the modular movement is held inside the receptacle at least in part by a wearer's body.

* * * * *